US009517817B1

(12) United States Patent
Scheidler

(10) Patent No.: US 9,517,817 B1
(45) Date of Patent: Dec. 13, 2016

(54) PERSONAL FLOATATION ASSEMBLY

(71) Applicant: Jeanine Scheidler, Williamsburg, OH (US)

(72) Inventor: Jeanine Scheidler, Williamsburg, OH (US)

( * ) Notice: Subject to any disclaimer, the term of this patent is extended or adjusted under 35 U.S.C. 154(b) by 0 days.

(21) Appl. No.: 14/751,412

(22) Filed: Jun. 26, 2015

(51) Int. Cl.
*B63C 9/08* (2006.01)
*B63B 35/58* (2006.01)
*B63B 35/73* (2006.01)

(52) U.S. Cl.
CPC ..... *B63B 35/58* (2013.01); *B63B 35/73* (2013.01)

(58) Field of Classification Search
USPC ..... 441/129–132
See application file for complete search history.

(56) References Cited

U.S. PATENT DOCUMENTS 581,862 A 5/1897 Holm
2,623,574 A * 12/1952 Damsch ..... A47C 1/146 297/1
3,380,088 A * 4/1968 Adesky ..... A47C 17/78 441/129
4,723,329 A * 2/1988 Vaccaro ..... A47C 15/006 441/129
5,237,713 A 8/1993 Prager
D343,980 S 2/1994 Torchia
5,406,653 A 4/1995 Todor
D571,429 S * 6/2008 Roberts ..... D21/803
7,536,740 B1 5/2009 Swartz
8,747,175 B1 6/2014 Frenna
2013/0154315 A1 6/2013 Kilzer

* cited by examiner

*Primary Examiner* — Stephen Avila

(57) ABSTRACT

A personal floatation assembly includes a housing that has a first end, a second end, a first lateral side, a second lateral side, a top wall and a bottom wall. The housing is comprised of a flexible and air impermeable material such that the housing can be inflated to support a body on water. A torso support is positioned on the top wall. The torso support is elongated and extends between the first lateral edge and the second lateral edge. The torso support is spaced between 2.0 feet and 3.0 feet from the first end and is spaced from the second end at least 2.0 feet. The torso support is comprised of a flexible and air impermeable material such that the torso support can be inflated.

5 Claims, 3 Drawing Sheets

PERSONAL FLOATATION ASSEMBLY

BACKGROUND OF THE DISCLOSURE

Field of the Disclosure

The disclosure relates to inflatable mat devices and more particularly pertains to a new inflatable mat device for supporting a person's midsection while the person is lying on the mat.

SUMMARY OF THE DISCLOSURE

An embodiment of the disclosure meets the needs presented above by generally comprising a housing that has a first end, a second end, a first lateral side, a second lateral side, a top wall and a bottom wall. The housing is comprised of flexible and air impermeable material such that the housing can be inflated to support a body on water. A torso support is positioned on the top wall. The torso support is elongated and extends between the first lateral edge and the second lateral edge. The torso support is spaced between 2.0 feet and 3.0 feet from the first end and is spaced from the second end at least 2.0 feet. The torso support is comprised of a flexible and air impermeable material such that the torso support can be inflated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
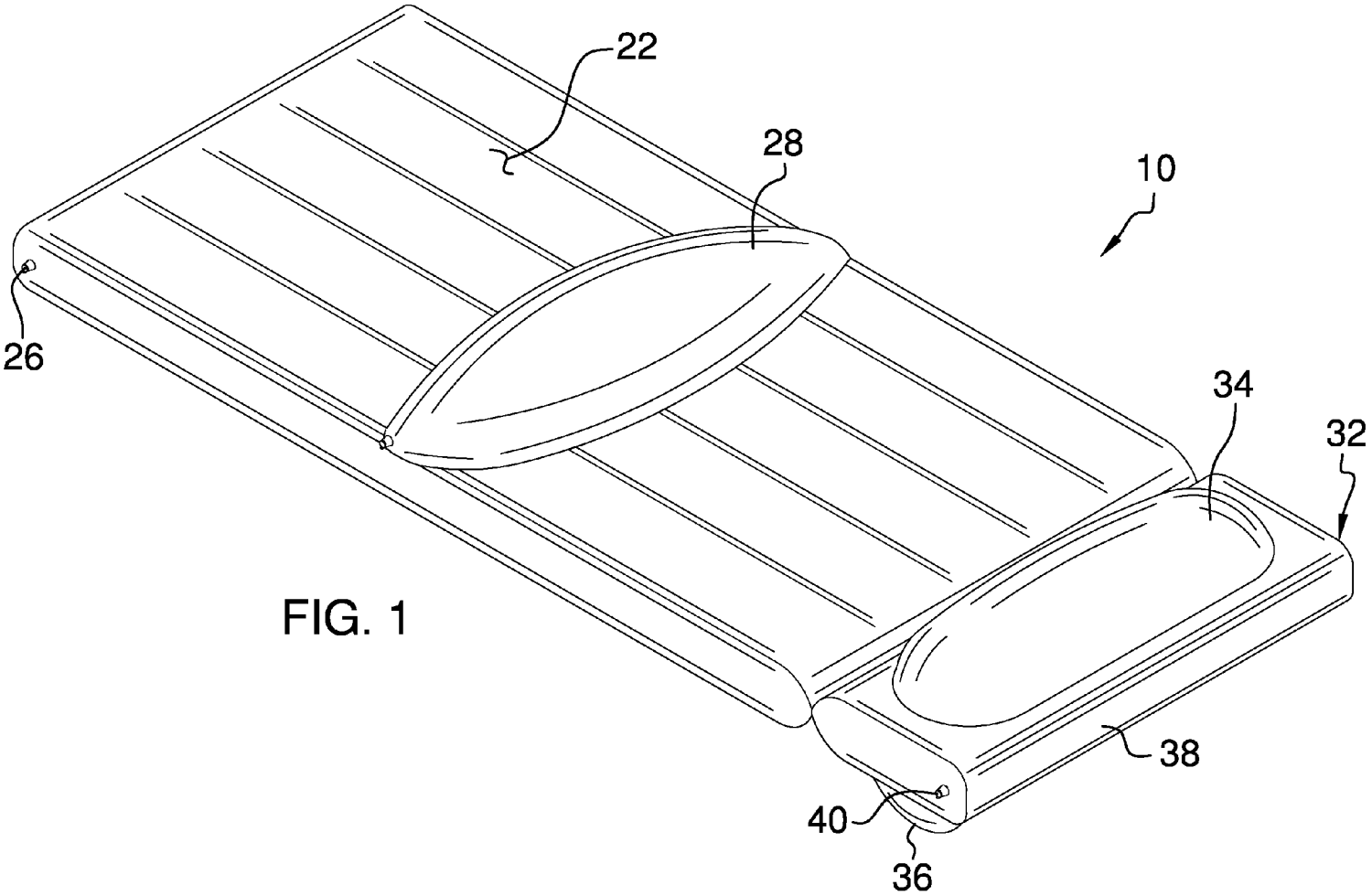
FIG. 1 is a top perspective view of a personal floatation assembly according to an embodiment of the disclosure.
Figure 2:
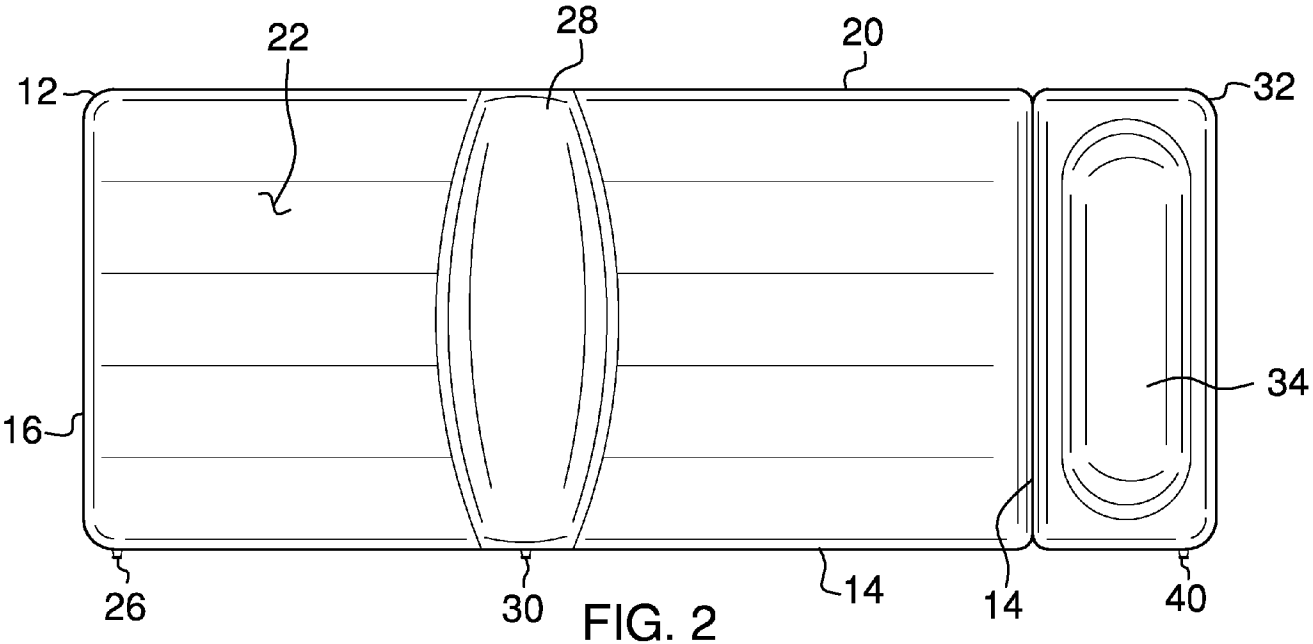
FIG. 2 is a top view of an embodiment of the disclosure.
Figure 3:
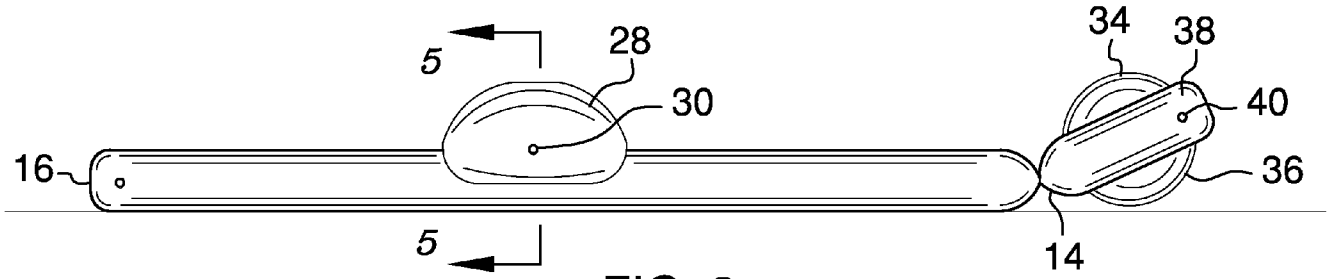
FIG. 3 is a side view of an embodiment of the disclosure.
Figure 4:
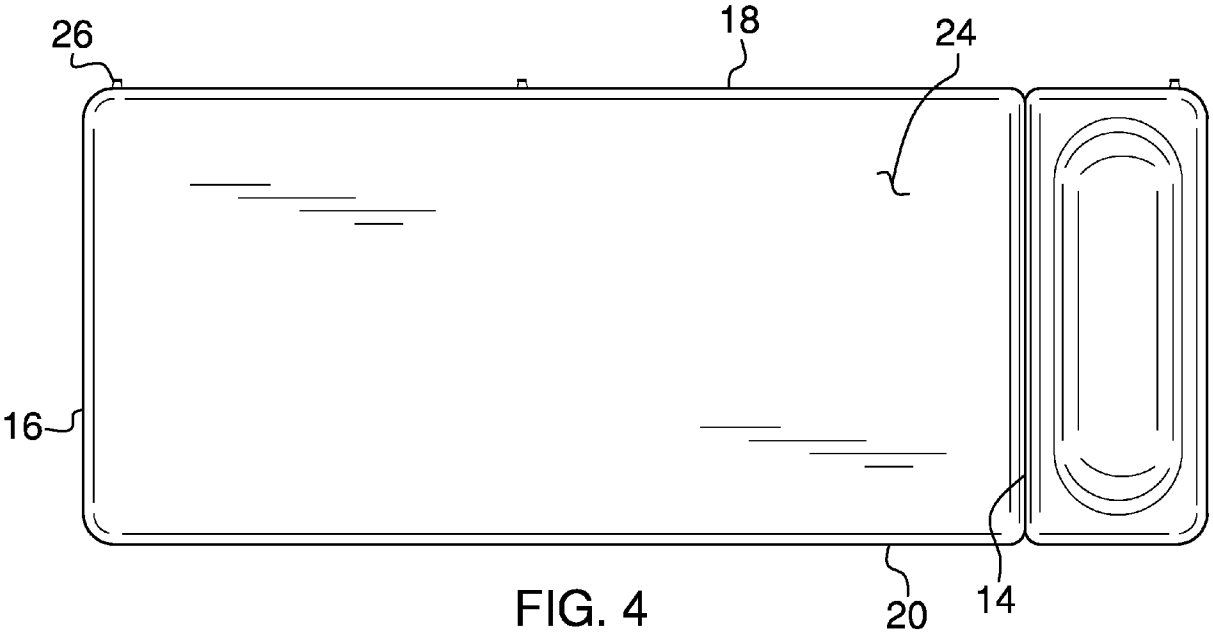
FIG. 4 is a bottom view of an embodiment of the disclosure.
Figure 5:
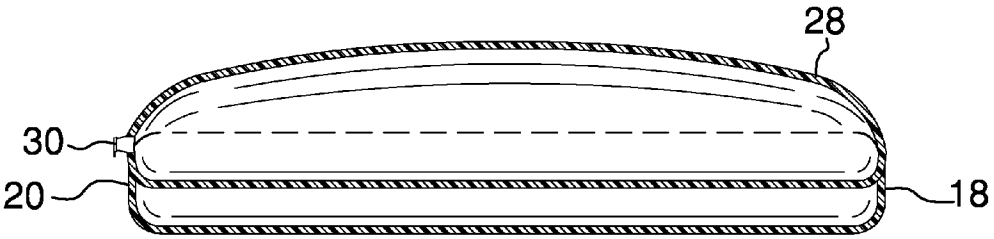
FIG. 5 is a cross-sectional view of an embodiment of the disclosure taken along line 5-5 of FIG. 3.

With reference now to the drawings, and in particular to FIGS. 1 through 5 thereof, a new inflatable mat device embodying the principles and concepts of an embodiment of the disclosure and generally designated by the reference numeral 10 will be described.

As best illustrated in FIGS. 1 through 5, the personal floatation assembly 10 generally comprises a housing 12 that has a first end 14, a second end 16, a first lateral side 18, a second lateral side 20, a top wall 22 and a bottom wall 24. The housing 12 is comprised of flexible and air impermeable material such that the housing 12 can be inflated to support a body on water. The flexible and air impermeable material may include an elastomer or plastic material. One or more valves 26 or conduits may be provided for filling the housing 12 with air. The housing 12 has a length from the first end 14 to the second end 16 between 4.5 feet and 7.0 feet and the housing has a width from the first lateral side 18 to the second lateral side 20 between 2.5 feet and 4.0 feet. The housing 12 may be generally analogous to a conventional inflatable mattress used by persons for floating on water in a pool, a lake or the like.

A torso support 28 is positioned on the top wall 22. The torso support 28 is elongated and extends between the first lateral edge 18 and the second lateral edge 20. The torso support 28 is spaced between 2.0 feet and 3.0 feet from the first end 14 and is spaced from the second end 16 at least 2.0 feet. The torso support 28 is comprised of a flexible and air impermeable material such that the torso support 28 can be inflated. The torso support 28 is convexly arcuate and extending upwardly from the top wall 22 a distance of at least 3.0 inches and up to 8.0 inches. The torso support 28 provides additional stability, or buoyancy due to additionally air containment, in a central area of the housing 12 such that when a person lies on the housing 12 on water, the central area does not sink. This will allow the person to lie upon their stomach without an uncomfortable arch being formed in their back from the central area sinking. The torso support 28 may include its own valve 30 or conduit, or the torso support 28 may be in fluid communication with the housing 12.

A headrest 32 is attached to and extends along the first end 14. The headrest 32 is comprised of a flexible and air impermeable material such that the headrest 32 can be inflated. The headrest 32 has a top side 34 and a bottom side 36. The top side 34 is convexly arcuate and the bottom side 36 is convexly arcuate. More particularly, the headrest 32 may have a middle section 38 positioned between the top 34 and bottom 36 sides. The convexly arcuate areas of the headrest 32 extend upwardly and downwardly from the middle section 38 such that the headrest 32 may contain additional air to prevent the headrest 32 from sinking into the water and to retain the headrest 32 at an upwardly extending angle as it extends away from the housing 12. The headrest 32 may include a valve 40 or conduit as shown in FIG. 1, or the headrest 32 may be in fluid communication with the housing 32 such that the headrest 32 is inflated when the housing 12 is inflated.

In use, the housing 12, headrest 32 and torso support 28 are inflated and placed on water. The user of the assembly 10 will then lie on the housing 12 and will thereafter float on the water. The torso support 28 will ensure that the person's lower torso does not cause the housing 12 to bow downwardly in its central area particularly when the person is lying on their stomach.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A personal floatation assembly comprising:

a housing having a first end, a second end, a first lateral side, a second lateral side, a top wall and a bottom wall, said housing being comprised of flexible and air impermeable material such that said housing can be inflated to support a body on water; and a torso support being positioned on said top wall, said torso support being elongated and extending between said first lateral edge and said second lateral edge, said torso support being spaced between 2.0 feet and 3.0 feet from said first end and being spaced from said second end at least 2.0 feet, said torso support comprised of a flexible and air impermeable material such that said torso support can be inflated; and a headrest being attached to and extending along said first end, said headrest being comprised of a flexible and air impermeable material such that said headrest can be inflated, wherein said headrest has a top side and a bottom side, said top side being convexly arcuate, said bottom side being convexly arcuate, a maximum distance between said top side and said bottom side being greater than a thickness of said housing between said top wall and said bottom wall.

2. The personal floatation assembly according to claim 1, wherein said housing has a length from said first end to said second end between 4.5 feet and 7.0 feet, said housing having a width from said first lateral side to said second lateral side between 2.5 feet and 4.0 feet.

3. The personal floatation assembly according to claim 1, wherein said torso support being convexly arcuate and extending upwardly from said top wall a distance of at least 3.0 inches.

4. The personal floatation assembly according to claim 1, wherein said torso support being convexly arcuate.

5. A personal floatation assembly comprising:

a housing having a first end, a second end, a first lateral side, a second lateral side, a top wall and a bottom wall, said housing being comprised of flexible and air impermeable material such that said housing can be inflated to support a body on water, said housing having a length from said first end to said second end between 4.5 feet and 7.0 feet, said housing having a width from said first lateral side to said second lateral side between 2.5 feet and 4.0 feet;

a torso support being positioned on said top wall, said torso support being elongated and extending between said first lateral edge and said second lateral edge, said torso support being spaced between 2.0 feet and 3.0 feet from said first end and being spaced from said second end at least 2.0 feet, said torso support comprised of a flexible and air impermeable material such that said torso support can be inflated, said torso support being convexly arcuate and extending upwardly from said top wall a distance of at least 3.0 inches; and a headrest being attached to and extending along said first end, said headrest being comprised of a flexible and air impermeable material such that said headrest can be inflated, said headrest having a top side and a bottom side, said top side being convexly arcuate, said bottom side being convexly arcuate, a maximum distance between said top side and said bottom side being greater than a thickness of said housing between said top wall and said bottom wall.

* * * * *